US005184098A

United States Patent [19]

Kich et al.

[11] Patent Number: 5,184,098

[45] Date of Patent: Feb. 2, 1993

[54] SWITCHABLE DUAL MODE DIRECTIONAL FILTER SYSTEM

[75] Inventors: Rolf Kich, Redondo Beach; Paul J. Tatomir, Laguna Niguel, both of Calif.

[73] Assignee: Hughes Aircraft Company, Los Angeles, Calif.

[21] Appl. No.: 832,877

[22] Filed: Feb. 10, 1992

[51] Int. Cl.[5] ..... H01P 1/208

[52] U.S. Cl. ..... 333/208; 333/110; 333/230

[58] Field of Search ..... 333/101, 108, 109, 1, 333/111, 113, 114, 135, 137, 208-212, 230, 248, 21 A, 21 R, 227

[56] References Cited

U.S. PATENT DOCUMENTS

| | | | |
|---|---|---|---|
| 2,595,680 | 5/1952 | Lewis | 333/110 |
| 4,554,553 | 11/1985 | Grim | 333/21 RX |
| 4,780,694 | 10/1988 | Kick et al. | 333/208 |
| 4,965,868 | 10/1990 | Wong et al. | 333/21 A |

*Primary Examiner*—Robert J. Pascal

*Assistant Examiner*—Seung Ham

*Attorney, Agent, or Firm*—Gordon R. Lindeen, III; Wanda K. Denson-Low

[57] ABSTRACT

A switchable dual mode directional filter system includes two identical filters coupled to input and output waveguides at the same plane in phase quadrature. Each waveguide has two ports through which the signal enters and exists. One of the filters has a switching device incorporated therein for selecting the desired output port. One embodiment of the switching device includes a pair of coupling members that extend radially inward within the cavity of the filter toward a central axis. These coupling members define two coupling positions for the system. Solenoids move the two coupling members into and out of the cavity of the filters. Only one coupling member is used at a given time. This switching device is designed to change the polarity of one of the components of the signal wave to change its wave characteristics in the output waveguide. As a result, the desired port of the output waveguide can be selected easily.

10 Claims, 4 Drawing Sheets

FIG. 1
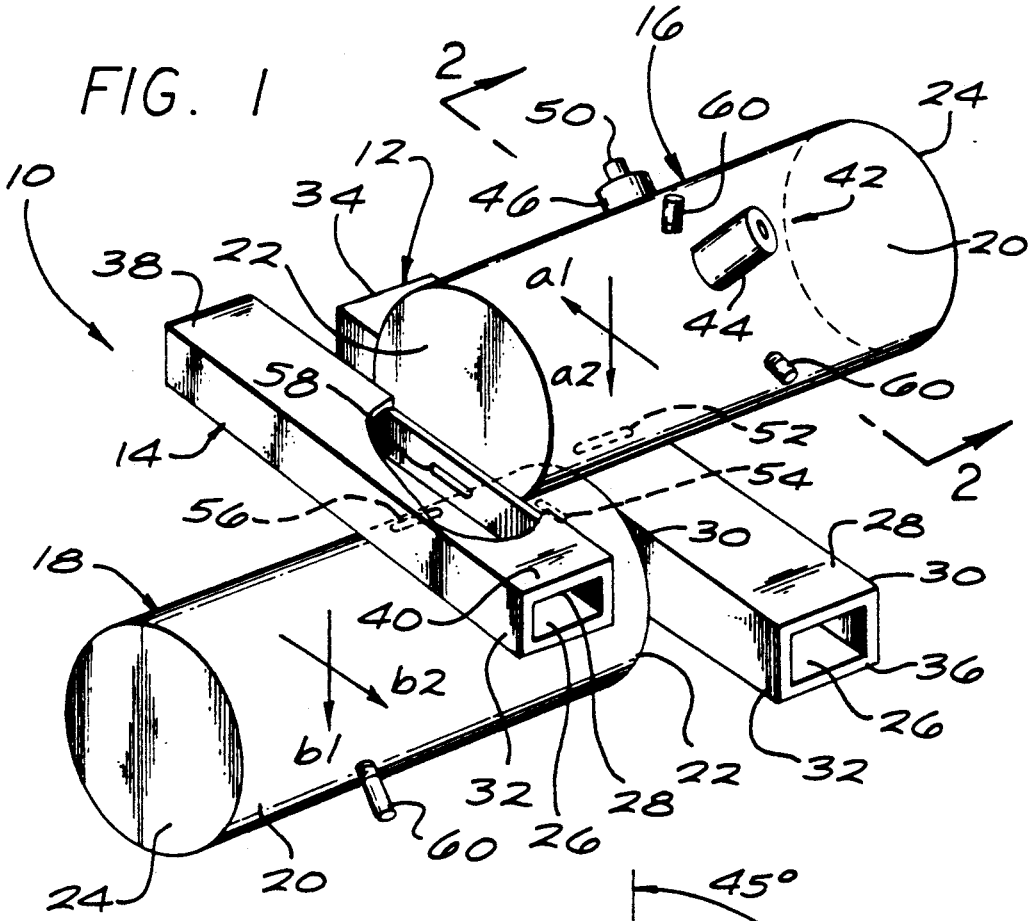
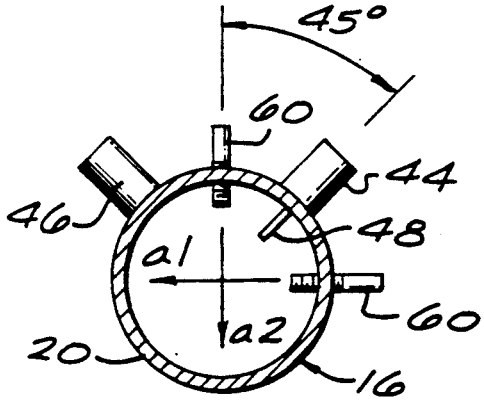
FIG. 2
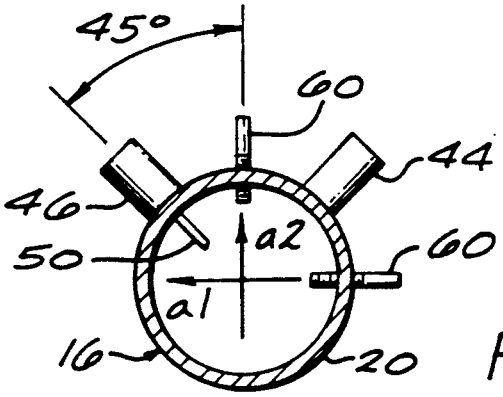
FIG. 3

FIG. 6
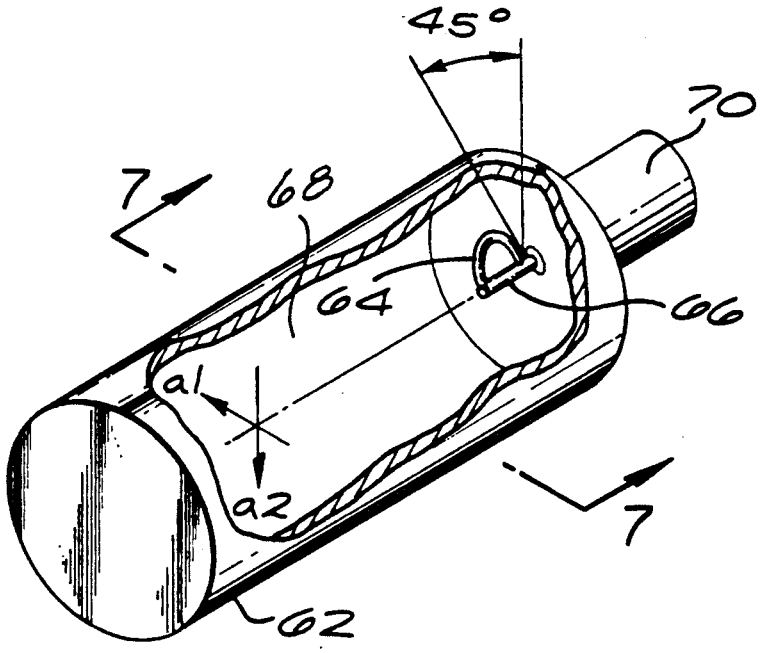
FIG. 7
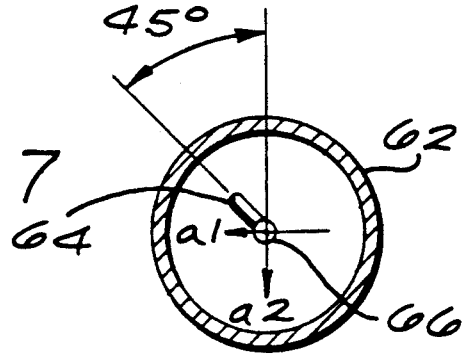
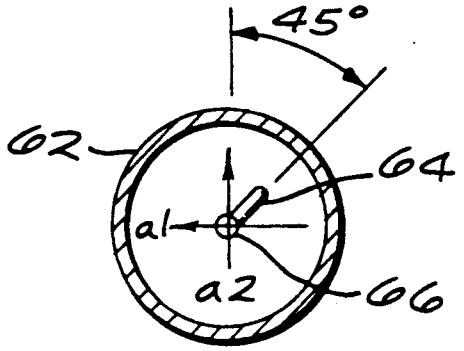
FIG. 8

SWITCHABLE DUAL MODE DIRECTIONAL FILTER SYSTEM

BACKGROUND ON THE INVENTION

1. Field of the Invention

The present invention relates to four-port directional filters and, more particularly, to a dual mode filter system that utilizes a pair of filters connected in phase quadrature between an input and output waveguide and includes a novel switching device incorporated into one of the filters for directing and switching the propagation of the output signal between the two ports of the output waveguide.

2. Description of the Prior Art

Filters used in the processing of electromagnetic waves are well known in the art. Many employ a common construction which includes a series of cavities constructed from a cylindrical wall that is closed off at both ends. Divider walls are sometimes utilized within the cylindrical wall to form additional cavities, one behind the other. These walls are generally made from an electrically conducting material, such as aluminum, brass or silver-plated steel.

The filter also includes a coupling device for coupling power from both a longitudinal component and a transverse component of the wave being filtered. In the case of a transverse electrical wave, the coupling device couples power from the magnetic field of the wave. When an electrical wave is being filtered, the coupling device usually takes the form of distinctly shaped apertures formed on the divider walls for coupling the electromagnetic power between adjacent cavities. Alternatively, if a transverse magnetic wave is being filtered, then the coupling device couples power from the longitudinal and transverse component of the electrical field of the transverse magnetic wave. The coupling device used with such a wave generally utilizes probes, rather than slots, for coupling the components of the electrical field into the cavities of the filters. The dimensions of the cavities and the configurations and positions of the apertures or probes are selected to provide the desired band pass characteristics to the signals (waves) propagating through the filters.

One problem associated with such filters occurs when several signals are being filtered simultaneously by a number of filters. Signal distortion can occur if the signals outputted by individual filters interfere with the operation of adjacent filters. The solution to this problem requires the various filters to be electrically isolated from each other to avoid improper signal combination.

One solution to this isolation or signal distortion problem includes the development of the four-port filter. These filters allow for connection of several filters to a single manifold without interference between filters. This form of filter includes two input ports and two output ports. The filter is designed so that a signal applied to one of two input ports exits from only one designated output port.

One particularly useful four-port filter system is disclosed in our issued U.S. Pat. No. 4,780,694 for a Directional Filter System, the disclosure of which is hereby incorporated by reference. That particular filter system utilizes a pair of matched filters interconnected between an output and input waveguide. Both waveguides are provided with coupling means for coupling power from both a longitudinal and transverse component of a magnetic field of a transverse electrical wave. That particular filter system creates a phase quadrature relationship and results in the generation of an output wave or signal which propagates through one of two ports of the output waveguide. The filter operates such that a wave inputted into one of the input ports will produce an output wave that will propagate through only one particular output port. The operation is reciprocal in that a wave generated through the other input port will exit only from the other output port.

Our previous filter system can be utilized for numerous applications, including use on satellites and other communication systems. In order to change the propagation of the output wave from port to port of the output waveguide, an appropriate external switch and housing must be included. This external switch can be implemented to select the correct input port of the input waveguide, in order to switch the signal propagated when desired. In some applications, numerous directional filters must be used and each must have its own external waveguide switch and housing. In satellite use, the need for additional switches and housings usually increases the overall weight of the satellite, thus increasing the cost to deploy and maintain the satellite in orbit. Therefore, it would certainly be beneficial and advantageous if the filter system could utilize a switching device which eliminates the need for a separate waveguide switch housing. The resulting filter system would realize at least a nominal weight savings for each filter that is utilized. However, such a switching device would have to perform without any negative impact on the integrity of the filter system.

SUMMARY OF THE INVENTION

The present invention provides an advantageous switchable dual mode directional filter system which utilizes switching means incorporated into only one of two filters encompassed by the system, for directing and switching the propagation of the output signal, or wave, between the two output ports of the system. The present invention eliminates the need for an external switch and housing for selecting the correct input port in order to obtain its corresponding output port. As a result, weight savings are gained without any impact on the system's performance.

Basically, the filter system utilizes a pair of matched filters that are interconnected between an input waveguide and an output waveguide. Input coupling means are included for coupling power from an electromagnetic signal into the filters. Output coupling means are also included for coupling signals outputted by the filters into the output waveguide.

The input coupling means couples power from the transverse field component of the electromagnetic signal to a first filter of the system and power from the longitudinal field component of the electromagnetic signal to the second filter of the system. The coupling means can be, for example, formed slots for coupling the components of the input wave, the transverse component being coupled by a slot in a wall of the filter disposed transverse to the longitudinal axis of the input waveguide. The longitudinal component can also be coupled through a slot disposed in the wall of the waveguide which is parallel to the longitudinal axis of the waveguide. Each slot continues into its respective filter.

The output coupling means includes similar longitudinal and transverse slots found on the output waveguide for coupling the signal into that waveguide. The transverse slot in the output waveguide causes the signal to radiate into the waveguide in an asymmetrical or antisymmetric radiation pattern such that the electric field traveling through the waveguide on either side of the slot have the opposite sense. Conversely, the longitudinal slot of the waveguide cause a symmetrically radiating signal in that the electric fields traveling through the waveguide on either side of the slot have the same sense. These slots are centered on a common transverse plane in the input waveguide, and similarly within the output waveguide. The signal coupled by these slots have a transverse component which is 90° out of phase with the longitudinal component. Therefore, the coupling of the electromagnetic power from the input waveguide into the two filters is done in phase quadrature.

One of the two filters is equipped with switching means which can be utilized to change the propagation of the output signal between the two output ports regardless of which input port is used. In general terms, the switching means is designed to change the polarity of one of the components of the signal which propagates through that particular filter in order to reverse its wave characteristics as it propagates into the output waveguide. In the description of the invention, the signal will be discussed in terms of its E-field vectors utilizing the symbols a1 and a2 to denote one set of vectors that propagate through the first filter and symbols b1 and b2 for the E-field vectors that propagate through the second filter of the system. The ability of the switching means to change the polarity of one of the E-field vectors changes the manner in which the waves radiate into the output waveguide and the manner in which the waves either cancel or combine within the output waveguide. The change of the polarity of one of the vectors results in the change of propagation to the desired output port. As a result, the switching means is designed to switch the polarity of the E-field vectors in a manner which results in a overall system that is much more lightweight than a system that utilizes an external switch and housing.

In one particular form of the invention, the switching means includes a pair of solenoids which are mounted to the outer surface of one of the filters. Each solenoid moves a coupling post which extends radially inward from the side wall of the filter towards a central axis of the filter. These posts are inclined at a 45° angle from longitudinal and transverse components of the E-field which enters the filter. Only one of the coupling posts is utilized at a given time during operation of the filter. At that time, the coupling post is extended within the filter towards its central axis. The other coupling post is moved out of the interior cavity of the filter to prevent any interference. When the other output port is desired to be utilized, the solenoid can be energized to move the second coupling post into the cavity of the filter while the other post is moved out of the filter by the other solenoid.

Another embodiment of the switching device includes a small wire loop that is connected to a dielectric shaft that extends through one of the end walls of the filter. The dielectric shaft is connected to an external motor which is attached to the outer surface of the filter. This motor allows the loop to be rotated 90° from one coupling position to another so that the polarity of one of the E-field vectors can be reversed. As a result of moving this wire loop, the propagation of the output wave can also be easily changed from one output port to the other.

BRIEF DESCRIPTION OF THE DRAWINGS

The foregoing aspects and other the invention will become more apparent from the following detailed description of the preferred embodiments, taken in conjunction with the accompanying drawings in which:

FIG. 1 is a perspective view of an assembly incorporating a switchable dual mode directional filter built in accordance with the present invention.

FIG. 2 is a cross-sectional of the assembly as viewed alon line 2—2 of FIG. 1;

FIG. 3 is a similar cross-sectional view as depicted in FIG. 2 showing the alternative position of the coupling post that changes the polarity of the E-field vector a2.

FIG. 4A shows the manner in which the E-field vector a2 radiates into the output waveguide. FIG. 4B shows the manner in which the E-field vector b2 radiates into the output waveguide. FIG. 4C shows the resulting combination of FIGS. 4A and 4B in which the signals combine at port D and cancel at port C.

FIG. 5A shows the manner in which the E-field vector a2 radiates into the output waveguide. FIG. 5B shows the manner in which the E-field vectors b2 radiate into the output waveguide. FIG. 5C shows the resulting combination of FIGS. 4A and 4B in which the signals combine at port C and cancel at port D.

FIG. 6 is a perspective view of a filter having a partially removed section which shows an alternative switching device shown as a movable wire loop on a dielectric shaft that can be utilized for changing the polarity of the E-field vector.

FIG. 7 is a cross-sectional view of the filter taken along line 7—7 of FIG. 6.

FIG. 8 is a similar cross-sectional view as depicted in FIG. 7 showing the wire loop in an alternative position for changing the polarity of the E-field vector.

DETAILED DESCRIPTION OF THE PREFERRED EMBODIMENTS

Figure 4A:
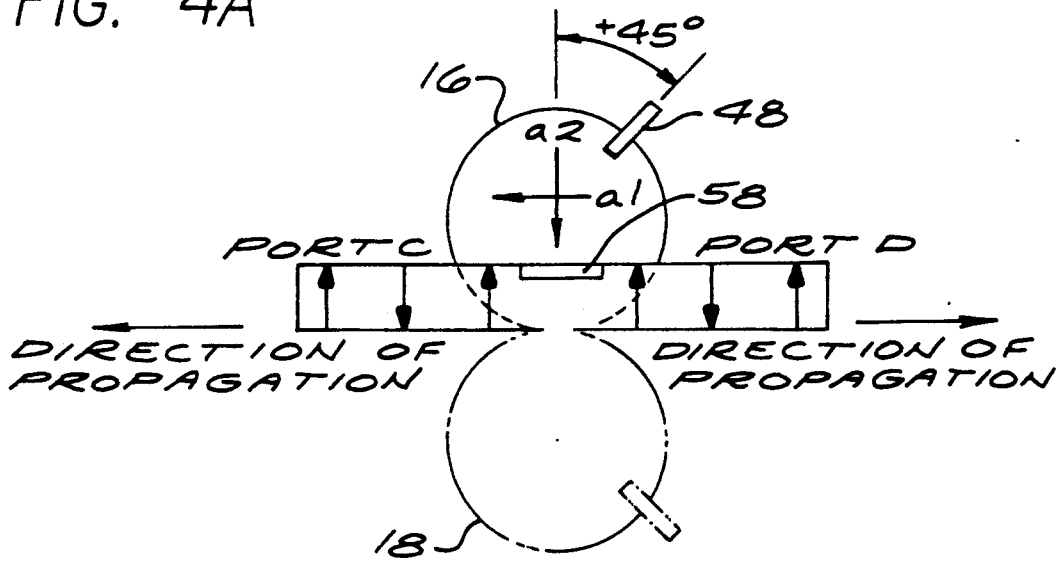
FIGS. 4A, 4B and 4C depict a schematic end view showing the two filters and the output waveguide having ports C and D and the manner in which the output wave propagates through each filter.

A switchable dual mode directional filter system utilizes a switching device in one of the filters to change the propagation of the output signal between two output ports. The system is an advance over prior art systems since an external switching mechanism and waveguide housing are no longer needed to select the desired output location. As a result, a weight savings for the system can be achieved which is particularly advantageous in those application in which weight or structural considerations are critical, such as in the use of satellites and other telecommunication systems.

FIG. 1 illustrates a general arrangement of a filter system (10) made in accordance with the present invention. The system (10) is formed with an input waveguide (12) and an output waveguide (14) which are interconnected by two parallel signal paths provided by a first filter (16) and a second filter (18). The theory of the invention is not restricted to any specific physical shape of the filter; however, the two filters (16) and (18)

should have identical characteristics particularly with respect to phase shift and signal group delay between input and output terminals of each of the filters (16) and (18).

The particular form of the invention shown in FIG. 1 utilizes a filter constructed from a right cylindrical side wall (20) closed off by a front end wall (22) and a back end wall (24) to form a set of resonators constructed as a set of serially arranged cavities. Each filter may also contain a divider wall (not shown) disposed between the front and back end walls (22) and (24) to form additional cavities. The filters (16) and (18), as well as the waveguides (12) and (14), are constructed of electrically conducting material, preferably a metal such as aluminum, brass or silver plated steel.

Each of the wave guides (12) and (14) is constructed of four side walls, two of which are broad walls (26) and (28) and two of which are narrow walls (30) and (32). These walls cooperate to form a rectangular cross section. The side walls of the input waveguide 12 are specifically positioned parallel to the side walls of the output waveguide (14).

The input waveguide (12) has a pair of opposing ends which serve as input ports for the system. In the foregoing embodiments, the input waveguide (12) has an input port A designated by numeral (34) and an input port B designated by numeral (36). Similarly, the output waveguide 14 has a pair of opposing open ends which also serve as output ports for the system. In the drawings, the output waveguide (14) has an output port C designated by numeral (38) and an output port D designated by numeral (40). In operation, an electromagnetic wave is input into one of the input ports and the filtered wave is output from only one of the two output ports. The operation of this filter system will be described in greater detail below.

In the preferred embodiments of the invention, each of the waveguides (12) and (14) supports a transverse magnetic wave in which an electric field of the wave has both the transverse component and a longitudinal component, the transverse and longitudinal components being out of phase by 90°. In the drawings, these longitudinal and transverse components, are shown and will be described in terms of their E-field vectors, which are designated by crossing arrows. In the first filter (16), the E-field vectors are designated by the arrows a1 and a2. In the second filter (18), the E-field vectors are designated by the arrows b1 and b2. In accordance with the invention, electromagnetic power from the input wave is coupled separately from the transverse and longitudinal components of the E-field to respective ones of the cavities from the input waveguide (12). Similarly, power from the electromagnetic wave established within each of the filters is separately coupled into the output waveguide to establish therein transverse and longitudinal components of the E-field of the output wave.

In the embodiment shown in the drawings, the first filter (16) is equipped with switching means (42) which are used to change the polarity of the E-field vector a2 within the filter. Referring to FIG. 1 again, one particular form of the switching means (42) is shown as a first solenoid (44) and second solenoid (46) which are mounted to the surface of the cylindrical side wall (20). The first solenoid (44) includes a coupling post (48) (See FIG. 2) which extends radially inward from the side wall toward a central axis of the filter. This coupling post (48) is specifically placed so that it extends inward at an angle of 45° with the E-field vector a2. The second solenoid (46) actuates a second coupling post (50) shown in FIG. 3. This second coupling post (50) is also positioned on the cylindrical side wall (20) so that it will extend radially inward toward a central axis on the filter. The position of the second coupling post is also at a 45° offset from the E-field vector a2 and is positioned 90° from the first coupling post (48).

In operation, only one of the two coupling posts extends into the filter at any given time. The solenoids can be wired together to move one coupling post into the filter while the other solenoid moves the other coupling post thereout. As can be seen in FIG. 2, when the first coupling post (48) is in the deployed position, the a2 vector extends downward. In FIG. 3, when the second coupling post (50) is in position, the polarity of the a2 vector is reversed and its direction is upward. As a result, the solenoids and coupling posts create a simple, but novel, way of changing the polarity of the a2 vector. The importance of changing the polarity of this vector will be further explained below.

In the preferred embodiments of the invention, the coupling of the transverse and longitudinal components of the E-field is accomplished by means of slots arranged transversely and longitudinally within the side walls of the input waveguide and the output waveguide. In this designation, it should be noted that the orientation of the slots are made in reference to the longitudinal axis of the waveguides. A total of four slots are employed to create the separate input and output coupling means used in accordance with the present invention.

Referring specifically now to FIG. 1, the input waveguide (12) includes a transverse slot (52) which is disposed in the broad wall (28) and extends through the side wall (20) of the first filter (16) for coupling electromagnetic power between the input waveguide and the first filter. The input waveguide also includes a longitudinal slot (54) which is disposed in the narrow wall (32) and extends through the front wall (22) of the second filter (18) for coupling electromagnetic power from the input waveguide (12 to the second filter (18).

The output waveguide (14) also include coupling means shown as a transverse slot (56) located in the broad wall (26) and extending through the side wall (20) of the second filter (18) for coupling electromagnetic power between the second filter and the output waveguide. A longitudinal slot (58) is disposed in the narrow wall (30) and extends through the front wall (22) of the first filter (16) for coupling electromagnetic power between the first filter and the input waveguide. These four slots (52), (54), (56) and (58), are all centered on a longitudinal plane of symmetry of the filter system.

In operation, the transverse slots radiate the signal, or wave, asymmetrically or anti-symmetrically in their respective waveguides. The longitudinal slots radiate symmetrically into their respective waveguides. During propagation of electromagnetic power between the input waveguide and output waveguide by each of the filters, the filters preserve the quadrature phase relationship of the electromagnetic power coupled from the longitudinal and transverse components of the E-field of the wave. The quadrature relationship in combination with the summation of symmetric and antisymmetric waves in the output waveguides produces an output wave which exits either from output port C or output port D. The specific output port is dependent upon whether the phase relationship is plus 90° or minus 90°.

Without switching means in one of the two filters, the phase relationship can be reversed only by reversing the point of application of the input signal between the two input ports. Therefore, application of an input signal to either one of the input ports will result in the output wave exiting from one of the output ports C or D. The switching means used in accordance with the present invention provides a simple way of changing the polarity of one of the components of the wave in order to direct the output wave to the desired output port.

Referring now specifically to FIGS. 4A, 4B, and 4C and 5A, 5B, and 5C, the operation of the filtering system made in accordance with the present invention can be better explained. Referring now specifically to FIGS. 4A, B and C, a schematic end view of the two filters (16) and (18) is shown along with a representation of the output waveguide (14). In FIG. 4A, the coupling post (48) is shown in the position depicted in FIG. 2. The E-field vector a2 is shown as it would appear as a downwardly directed vector within the first filter (16).

Figure 4B:
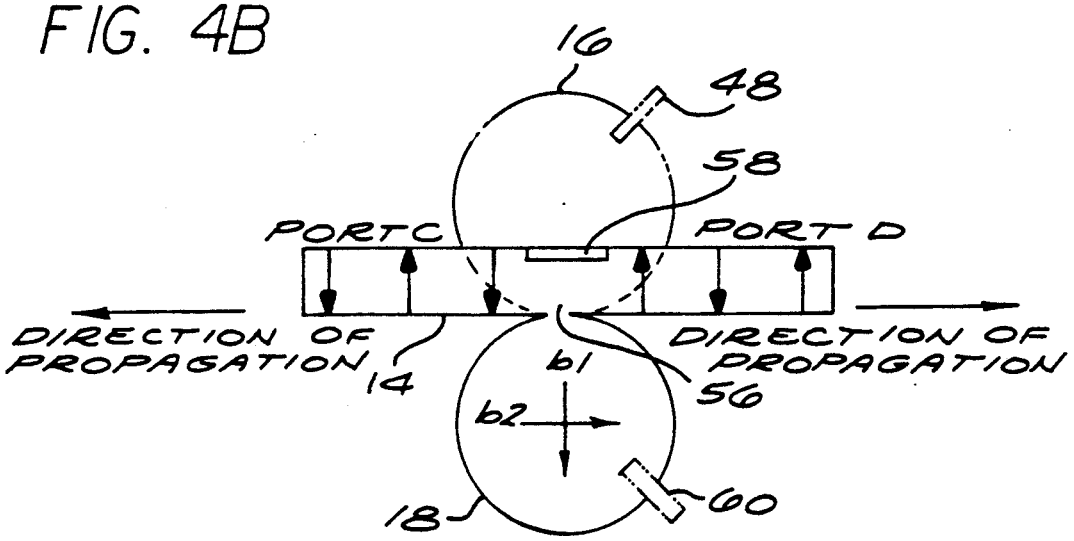
Figure 4C:
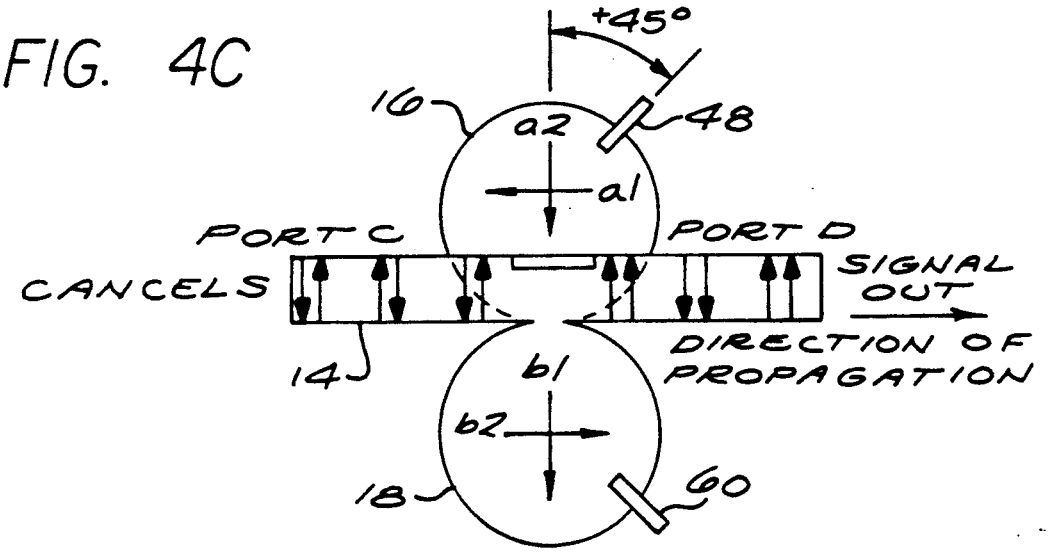

Specifically, in FIG. 4A, the E-field vector a2 would couple into the output waveguide through the longitudinal slot 58 where it would radiate a symmetrical propagating signal toward both ports C and D. The pattern of the wave within the waveguide are designated by arrows and the direction of propagation are clearly shown. As mentioned above, the symmetrical wave radiates such that the electric fields traveling through the waveguide on either side of the slot have the same sense. Referring now to FIG. 4B, the E-field vector b2 radiates into the output waveguide through the transverse slot 56 where the signal propagates asymmetrically toward both ports C and D. The arrows in the waveguide (14) demonstrate the asymmetrically propagating wave that would be generated. Again, the asymmetrical wave travels through the waveguide such that electric fields on either side of the transverse slot have the opposite sense. Now, in FIG. 4C, the wave output by the first and second filters are shown as they would combine and cancel within the output waveguide (14). In FIG. 4C, the signals combined at port D and cancel at port C which results in the output signal exiting through port D. There is no signal propagation through port C due to the cancellation of the signals.

Figure 5A:
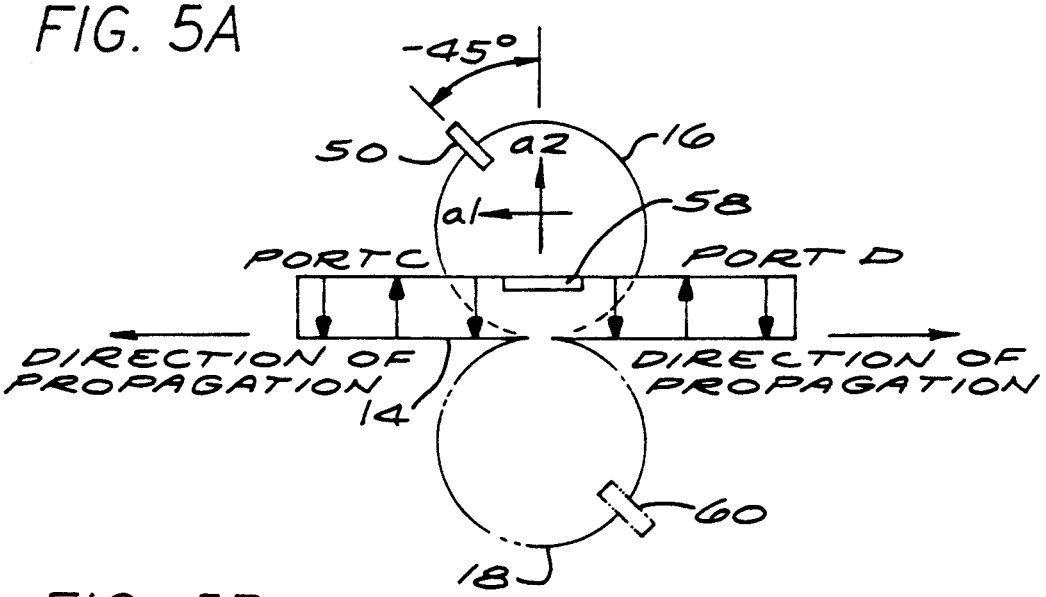
FIGS. 5A, 5B, and 5C depict a similar schematic end view showing the two filters and the output waveguide having ports C and D except the E-field vector a2 is reversed by the switching feature of the present invention.
Figure 5B:
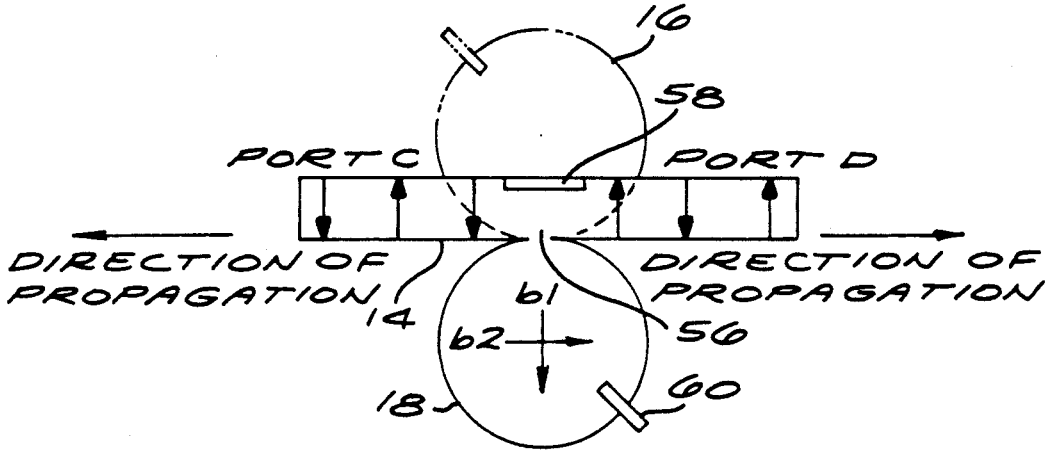
Figure 5C:
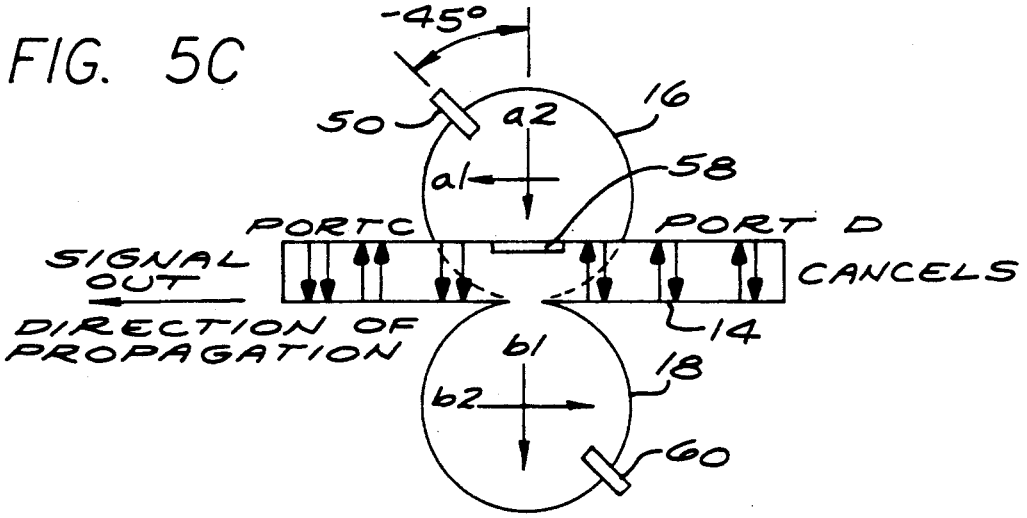

Referring now to FIGS. 5A, 5B, and 5C, the same first and second filters (16) and (18) are shown with a similar representation of the output waveguide (14). In these figures, however, the second coupling post (50) is utilized at the second position which causes a reversal of the polarity of the E-field vector a2. In FIG. 5A, the E-field vector a2 is shown in an upward direction, in direct contrast to its downward direction shown in FIGS. 4A. As a result of this change in the polarity, the direction of waves within the waveguide are also reversed (compare FIG. 4A to FIG. 5A). The E-field vector a2 still couples into the output waveguide through the longitudinal slot, however, the output signal is now polarity-reversed. The direction of propagation of this signal is again towards both ports C and D of the waveguide. Referring now to FIG. 5B, the E-field vector b2 again radiates through the transverse slot and propagates asymmetrically toward both ports. The propagation in FIG. 5B is similar to the asymmetrical propagation shown in FIG. 4B. Next, as is shown in FIG. 5C, the signals now combine at port C and cancel at port D, resulting in the signal propagating out of port C. Thus, as a result of moving the coupling post from a +45° position to a −45° position relative to the a2 vector, the output port through which the output signal propagates can be easily changed, regardless of which input port is being utilized. Therefore, the filter system still functions in accordance with the well known scattering matrix for four-port directional filters while providing an advantageous switching device for directing the output signal to either of the two output ports as desired.

The filters (16) and (18) shown in FIG. 1 also include tuning screws (60) which also extend radially inward from the side wall toward a central axis in each of the filters. Such screws provide for an interaction between waves coupled by a single slot, such as the transverse slot provided for dual modes of operation. These screws also are used for tuning the filters before operation.

An alternative embodiment of the switching means is further shown in FIGS. 6 through 8. In FIG. 6, only one filter of the system is shown and a portion of the side wall has been removed to better show the particular device that forms the switching means. It should be understood that this filter (62) is similar to the one shown in FIG. 1 and would be attached to an input and output waveguide as is shown in FIG. 1. The switching means used on this filter (62) includes a small wire loop (64) which is connected to a dielectric shaft (66) that extends into the internal cavity (68) of the filter. This dielectric shaft (66) is connected to an external motor (70) which is mounted to the front wall (62) of the filter (72). The E-field vectors are designated by arrows a1 and a2 which are similar to the vectors shown in FIG. 1.

Referring now to FIGS. 7 and 8, the wire loop 64 is shown in two positions which cause the E-field vector a2 to change its polarity within this filter 62. Referring first to FIG. 7, the wire loop (64) is shown in a −45° position from the direction of the E-field vector a2. The position of the wire loop in FIG. 7 is similar to the position depicted in FIG. 6. Referring now to FIG. 8, the wire loop is shown rotated a full 90° to a +45° in which the polarity of the E-field vector a2 now changes. As a result of its ability to change the polarity of the E-field vector, this particular embodiment of the switching means can again direct the output signal to either of the output ports as desired.

As a result of using a switching device with one of the two filters of the system, the invention permits construction of a four-port directional filter in which the directional properties can be attained and controlled by the switching device. As a result, the output port can be chosen regardless of which input port is being utilized, thereby eliminating the need for an external switch and housing to change the direction of the signal between the two input ports. The result is a weight savings which can be considerable when used in applications in which weight consideration is of prime concern.

It is to be understood that the above described embodiments of the invention are illustrative only, and that modifications thereof may occur to those skilled in the art. Accordingly, this invention is not to be regarded as limited to the embodiments disclosed herein, but is to be limited as defined by the pending claims.

What is claimed is:

1. A switchable mode directional filter system comprising:

a first filter and a second filer;

an input waveguide defining a first input port and a second input port;

an output waveguide defining a first output port and a second output port;

input coupling means for coupling an input electromagnetic signal from said input waveguide into each of said filters;

output coupling means for coupling signals outputted by said filters into said output waveguide; and means operatively associated with at least one of said filters for switching the output signal between said first and second output ports.

2. The system as defined in claim 1 wherein said input electromagnetic signal includes an electric field having first and second components disposed in phase quadrature and wherein further, said input coupling means includes:

first input coupling means for coupling said electric field first component into said first filter for propagation towards said output waveguide; and second input coupling means for coupling said electric field second component into said second filter for propagation towards said output waveguide.

3. The system as defined in claim 2 wherein said output coupling means includes:

first output coupling means for coupling said electric field first component from said first filter into said output waveguide for propagation therethrough towards said first and second output ports in a symmetrical radiation pattern; and second output coupling means for coupling said electric field second component from said second filer into said output waveguide for propagation therethrough towards said first and second output ports in an asymmetrical radiation pattern.

4. The system as defined in claim 3 wherein said switching means includes means for reversing the polarity of said electric field first component from a first polarity to a second polarity, thereby causing said first and second components propagating towards said first output port to combine and be outputted therefrom as said output signal, and said first and second components propagating towards said second output port to cancel each other out.

5. The system as defined in claim 4 wherein said electric field first and second components comprise transverse and longitudinal components, respectively.

6. The system as defined in claim 4 wherein said first filter has an internal cavity and said switching means includes:

a first coupling member mounted to reciprocal movement relative to saif first filer internal cavity; and means for moving said first coupling member between a first position disposed substantially interiorly of said first filter internal cavity, wherein movement of said first coupling member from said first position to said second position effects reversal of the polarity of said electric field first component from said first polarity to said second polarity.

7. The system as defined in claim 6 wherein said first filter has an internal cavity and said switching means further includes:

a second coupling member mounted for reciprocal movement relative to said first filter internal cavity; and means for moving said second coupling member between a retracted position disposed substantially exteriorly of said first filter internal cavity, and an extended position disposed substantially interiorly of said first filter internval cavity, wherein movement of said second coupling member from said first position to said second position effects reversal of the polarity of said electric field first component from said second polarity to said first polarity, when said first coupling member is in said first position, thereby causing said first and second components propagating towards said first output port to cancel each other out, and said first and second components propagating towards said second output port to combine and be outputted therefrom as said output signal.

8. The system as defined in claim 2 wherein said switching means comprises means operatively associated with said first filter for reversing the phase relationship between said first and second components from $+90°$ to $-90°$ and vice versa, to thereby switch said output signal from said first output port to said second output port and vice versa.

9. The system as defined in claim 4 wherein said first filter has an internal cavity and said switching means includes:

a dielectric shaft extending into said internal cavity;

a loop member attached to said shaft; and means mounted to said first filter for rotating said shaft to thereby move said loop member from a first position to a second position, wherein movement of said loop member from said first position to said second position effects reversal of the polarity of said electric field first component from said first polarity to said second polarity.

10. The system as defined in claim 1, wherein said first and second filters are matched.

* * * * *